US007661209B2

(12) United States Patent
Arzberger et al.

(10) Patent No.: US 7,661,209 B2
(45) Date of Patent: Feb. 16, 2010

(54) FOUNDATION CONSTRUCTION DEVICE FOR PRODUCING TRENCHES IN THE SOIL

(75) Inventors: Maximilian Arzberger, Igenhausen (DE); Ignaz Seitle, Karlshuld (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 12/219,416

(22) Filed: Jul. 22, 2008

(65) Prior Publication Data

US 2009/0031590 A1 Feb. 5, 2009

(30) Foreign Application Priority Data

Jul. 30, 2007 (DE) ..... 10 2007 035 591

(51) Int. Cl.
*E02F 3/24* (2006.01)

(52) U.S. Cl. ..... 37/189; 37/364; 175/96; 299/75

(58) Field of Classification Search ..... 37/91, 37/189, 364, 352, 468, 365; 175/96, 91; 299/106, 75

See application file for complete search history.

(56) References Cited

U.S. PATENT DOCUMENTS

| | | | | |
|---|---|---|---|---|
| 2,637,527 | A * | 5/1953 | Andrews, Jr. | 175/94 |
| 3,894,587 | A * | 7/1975 | Sourice | 175/91 |
| 4,202,416 | A * | 5/1980 | Blaschke et al. | 175/94 |
| 5,707,182 | A | 1/1998 | Leffer | |
| 6,076,290 | A * | 6/2000 | Seitle et al. | 37/398 |
| 6,446,364 | B1 * | 9/2002 | Herrero Codina | 37/187 |
| 6,839,988 | B2 * | 1/2005 | Gessay et al. | 37/189 |
| 6,839,989 | B2 * | 1/2005 | Gessay et al. | 37/189 |
| 7,356,948 | B2 * | 4/2008 | Arzberger et al. | 37/365 |
| 7,363,733 | B2 * | 4/2008 | Stoetzer | 37/189 |
| 7,367,143 | B2 * | 5/2008 | Stoetzer | 37/189 |
| 2003/0037464 | A1 * | 2/2003 | Gessay et al. | 37/189 |
| 2006/0225308 | A1 | 10/2006 | Arzberger et al. | |

FOREIGN PATENT DOCUMENTS

| | | | |
|---|---|---|---|
| DE | 4119212 | A1 | 12/1992 |
| DE | 4309233 | C1 | 7/1994 |
| EP | 0553378 | A1 | 8/1993 |
| EP | 0593355 | A1 | 4/1994 |
| EP | 0 791 690 | B2 | 11/2004 |
| EP | 1703023 | A1 | 9/2006 |
| EP | 1746213 | A1 | 1/2007 |
| JP | 63-247425 | A | 10/1988 |
| JP | 03-241118 | A | 10/1991 |
| JP | 06-073735 | A | 3/1994 |

* cited by examiner

*Primary Examiner*—Thomas A Beach
(74) *Attorney, Agent, or Firm*—Jacobson Holman PLLC

(57) ABSTRACT

The invention relates to a foundation construction device for producing trenches in the soil comprising a frame, at least one soil-removing device arranged on the frame and a control device for controlling the foundation construction device in the trench, wherein the control device has at least one control body which can be adjusted between an inoperative position and a projecting control position in order to rest on a wall of the trench. Provision is made for the control body to be adjusted into a first projecting control position on a first side of the frame or into a second projecting control position on a second side of the frame that lies opposite the first side of the frame.

12 Claims, 4 Drawing Sheets

FOUNDATION CONSTRUCTION DEVICE FOR PRODUCING TRENCHES IN THE SOIL

BACKGROUND OF THE INVENTION

1. Field of the Invention

The invention relates to a foundation construction device for producing a trench in the soil. A device of such type is designed with a frame, at least one soil-removing device arranged on the frame and a control device for controlling the foundation construction device in the trench, wherein the control device has at least one control body which can be adjusted between an inoperative position and a projecting control position in order to rest on a wall of the trench.

2. Related Art

Such a foundation construction device is known from DE 41 19 212 A1. This printed publication discloses a trench wall cutter having two control flaps that are arranged on opposite vertical side walls of the cutting frame. By means of a hydraulic system the control flaps can be moved out of the outer contour of the cutting frame and thereby can be braced against the wall of the trench. As a result, on the cutting frame a torque can be generated in a predetermined direction, which permits a directional control of the cutting frame and therefore of the cutter.

A further foundation construction device for producing trenches in the soil with a steering and control device is known from EP 1 703 023 A1. This printed publication also teaches the use of two control flaps that are supported opposite each other on the frame, in which case the flaps can be moved by means of at least one common adjusting cylinder, a lever mechanism and a distributing device. In addition, at least one guide wheel can be provided which is arranged on the frame in an extendable and retractable manner.

Further trench wall devices with control flaps are known from JP 03-241118 A, JP 63-247425 A and JP 06-073735 A.

EP 1 746 213 A1 discloses a trench wall cutter, on the frame of which two control flaps are provided that are intended to function like the rudder blade of a boat or an elevator of a "canard-alar aircraft".

DE 43 09 233 C1, EP 0 553 378 A1 and EP 0 593 355 A1 disclose trench wall devices, in which the soil-removing device can be adjusted relative to the frame for directional control.

SUMMARY OF THE INVENTION

The object of the invention is to provide a foundation construction device for the production of trenches with a control device that has a particularly simple construction.

The object is solved in accordance with the invention by a foundation construction device having a frame, at least one soil-removing device arranged on the frame and a control device for controlling the foundation construction device in the trench, wherein the control device has at least one control body, which can be adjusted between an inoperative position and a projecting control position in order to rest on a wall of the trench, wherein the control body can be adjusted into a first projecting control position on a first side of the frame or into a second projecting control position on a second side of the frame that lies opposite the first side of the frame.

A foundation construction device according to the invention is characterized in that the control body can be adjusted into a first projecting control position on a first side of the frame or into a second projecting control position on a second side of the frame that lies opposite the first side of the frame.

A fundamental idea of the invention can be seen in the fact that the control body is designed in such a manner that, in contrast to what is known from prior art, it cannot be moved into a projecting position on only one side of the frame in each case for deflection of the cutter but it can be moved in an alternating manner into two opposite control positions on two opposite sides of the frame. This enables the foundation construction device to push away in an alternating manner from opposite lying inner walls of the trench, with only one single control body being required for this. Hence, by means of one single control body opposite directed control movements can be generated on the frame as required. According to the invention the number of control bodies required for a control function can therefore be reduced so that a foundation construction device is obtained that is both economical and has an especially simple construction.

For best suitability, the control device, more particularly its control body, is arranged on the frame of the foundation construction device. In the inoperative position the control body is preferably set backwards with respect to a cross-section of the frame and/or a removal cross-section of the soil-removing device towards the inside of the cross-section. In the control position the control body suitably projects beyond the cross-section of the frame and/or the removal cross-section of the soil-removing device. The inoperative position of the control body is preferably arranged between the two control positions and/or in a spatially lower position relative to the control positions.

It is particularly advantageous for the control body to be supported on the frame in a pivotable manner about a pivot axis. According to this embodiment a pivoting movement is carried out with the control body for adjustment between the control positions and the inoperative position. In this embodiment an especially reliable and robust control device can be obtained while the expense involved on the construction side is reduced further.

If the control body is designed in a pivotable manner, it is especially advantageous for the pivot axis to extend perpendicularly to the advance direction of the foundation construction device. As a result, a particularly compact foundation construction device can be achieved. In principle, provision can also be made for the pivot axis to be provided for example parallel to the advance direction. The advance direction can be understood in particular as the direction which extends from a suspension of the foundation construction device towards the soil-removing device, which extends parallel to an axis of symmetry of the soil-removing device and/or in which the soil-removing device can be sunk into the soil. The pivot axis is suitably provided in a fixed position on the frame.

Furthermore, it is preferred that the control body has an arched outer contour, in particular in the shape of a circular arc, in order to rest on the wall of the trench. The design of an arched outer contour proves to be especially advantageous if the control body can be pivoted. In such case the arched design of the contour can ensure that when the pivot angle is changed the control body slides with a low amount of friction along the wall of the trench so that the wall of the trench is not subjected to excessive stress. For best suitability the arched design of the contour is implemented in a plane extending perpendicularly to the pivot axis.

Especially in the case of an outer contour in the shape of a circular arc it is of advantage that the pivot axis extends eccentrically with respect to the arched outer contour of the control body. In this manner a variable adjustment distance of the control body in the preset control positions can be realized in an especially easy way, in which case the adjustment distance can be varied through a change of the pivot angle of the control body. To permit a change of the adjustment distance through a change of the pivot angle it is suitable that a variable distance between the pivot axis and the outer contour is provided along the arched outer contour.

Moreover, to achieve a control device that has an even further simplified construction and is especially robust it is advantageous that, following on from the arched outer contour in particular, the control body has a plane bearing surface, on which it is supported on the frame. For instance on the bearing surface a bearing eye can be provided, through which an axle or shaft arranged on the frame is guided through. For best suitability the control body has a segmental section in the transverse direction to the pivot axis, with the arched outer contour being formed on the segmental arch and the plane bearing surface being formed on the chord of the segment.

It is suitable for the control body to be arranged in such a manner that, at least in the inoperative position, its arched outer contour faces in the advance direction and its plane bearing surface faces away from the advance direction by being directed in particular towards a suspension of the frame. As a result, a jamming of the control body during sinking can be counteracted. If the pivot axis is arranged eccentrically on the control body, the control body, at least when being in the inoperative position, is preferably set forwards in the advance direction with respect to the pivot axis.

The expense involved on the construction side can be reduced further in that at least one hydraulic cylinder is provided for actuation of the control body, which is supported on the one hand on the frame and on the other hand on the control body. It is suitable for the hydraulic cylinder to be hinged on the control body on the plane bearing surface of the control body. For an especially low amount of maintenance work the hydraulic cylinder can be provided on the outside of the frame. It is useful for the hydraulic cylinder to be provided on a side of the control body facing towards the suspension of the foundation construction device and/or facing away from the soil-removing device. In this case the control body is able to protect the hydraulic cylinder against influences of the removed soil material.

An especially reliable control can be achieved in that two control bodies are provided in particular on opposite sides of the frame. Through the arrangement on opposite sides of the frame a turning of the frame about the advance direction can be prevented or even brought about selectively upon actuation of the control device. By preference, the control bodies are arranged in a pivotable manner about a common pivot axis, and in particular the common pivot axis extends perpendicularly to the advance direction.

It is especially useful that the control bodies are arranged in a rotationally fixed manner on a common shaft. In this way a synchronous movement of both control bodies is rendered possible in a particularly simple manner and the work required for the actuation of the control bodies can therefore be kept to an especially low level. The shaft preferably extends through the frame, in particular perpendicularly to the advance direction.

For an especially multi-purpose operation the two control bodies can also be pivoted relative to each other. In such case the control bodies can be supported on journals that are arranged on the frame. Alternatively, they can be arranged on separate shafts. Advantageously, the journals or respectively the separate shafts are arranged coaxially to each other and preferably extend perpendicularly to the advance direction.

An especially high operational safety can be attained in that at least one hydraulic cylinder is provided on each of the control bodies. Such an arrangement can also be provided in the case of a common shaft. Advantageously, the two hydraulic cylinders are arranged for a counter-directed pivoting operation of the common shaft and/or of the two control bodies. This can be understood in particular in that the common shaft is pivoted into a first direction of rotation when the first hydraulic cylinder is extended and is pivoted into an opposite second direction of rotation when the second hydraulic cylinder is extended. If a common shaft is provided, the hydraulic cylinders can be designed as single-acting cylinders whereby a particularly cost-effective foundation construction device can be obtained. However, to attain especially high control forces provision can also be made for double-acting cylinders. Instead of hydraulic cylinders linear drives of a different type can also be used.

For example with regard to the production of large trenches it is of particular advantage that the soil-removing device has a rectangular removal cross-section. It is especially preferred that the control body can be adjusted in the direction of a shorter rectangle side of the rectangular removal cross-section. For a control in the shorter direction the control body according to the invention can be employed in a particularly effective way because in this case it can be kept compact.

The soil-removing device can include a trench wall grab for example. However, to ensure a continuous operation even in changing soil geologies it is especially advantageous for the soil-removing device to have at least one rotatably driven cutting wheel. For best suitability at least two cutting wheel pairs positioned in front in the advance direction are provided next to each other on the frame so that a rectangular cutting cross-section can be achieved. To further improve the cutting effect and/or to achieve an additional mixing effect on the removed soil material, two additional wheel pairs positioned in the rear in the advance direction can be provided on the frame, i.e. in the part of the suspension of the frame. Advantageously, the front-positioned and rear-positioned cutting wheel pairs have at least approximately the same cross-section. The axes of the cutting wheel pairs suitably extend parallel to each other.

If at least one cutting wheel is provided, the cutting wheel axis suitably extends in the direction of the shorter rectangle side. Advantageously, the pivot axis of the control body is arranged perpendicularly to the cutting wheel axis.

By preference, the frame has, at least in sections, a cross-section that corresponds at least approximately to the removal cross-section, more particularly to the cutting cross-section of the soil-removing device. As a result, the frame is able to guide the foundation construction device in the trench produced by the soil-removing device. However, especially in the case of a rigid guidance of the foundation construction device it is also possible for the frame to have a smaller cross-section than the soil-removing device. The control body is suitably arranged in a part of the frame, in which the frame is designed in a tapering manner. Through this the control body can be prevented from making undesired contact with the wall of the trench in the inoperative position. The control body is suitably arranged on the outside of the frame.

By preference, the frame can be designed at least in portions in a box-shaped manner and, in particular, have an interior space sealed towards the outside, in which e.g. driving elements for the soil-removing device can be arranged. The control body is suitably arranged in an approximately square-shaped frame part.

For an especially reliable operation the device can have at least one pick-up, which is preferably inductive and serves to detect the position of the control body. This can be an angle pick-up in particular. For best suitability the pick-up is arranged in the interior space of the frame where it is protected very well.

The invention also relates to a method for producing a trench in the soil, in which a foundation construction device according to the invention is introduced into the soil and in doing so the control body is actuated in order to control the foundation construction device.

Advantageously, as early as during the introduction of the foundation construction device into the soil a hardening material is introduced into the trench which is mixed inside the trench, especially through the effect of the cutting wheels, with the soil material removed by the soil-removing device.

BRIEF DESCRIPTION OF THE DRAWINGS

In the following the invention will be described in greater detail by way of preferred embodiments shown schematically in the accompanying drawings, wherein.

Elements having the same function are designated throughout the Figures with the same reference signs.

DETAILED DESCRIPTION OF THE PREFERRED EMBODIMENTS

Figure 1:
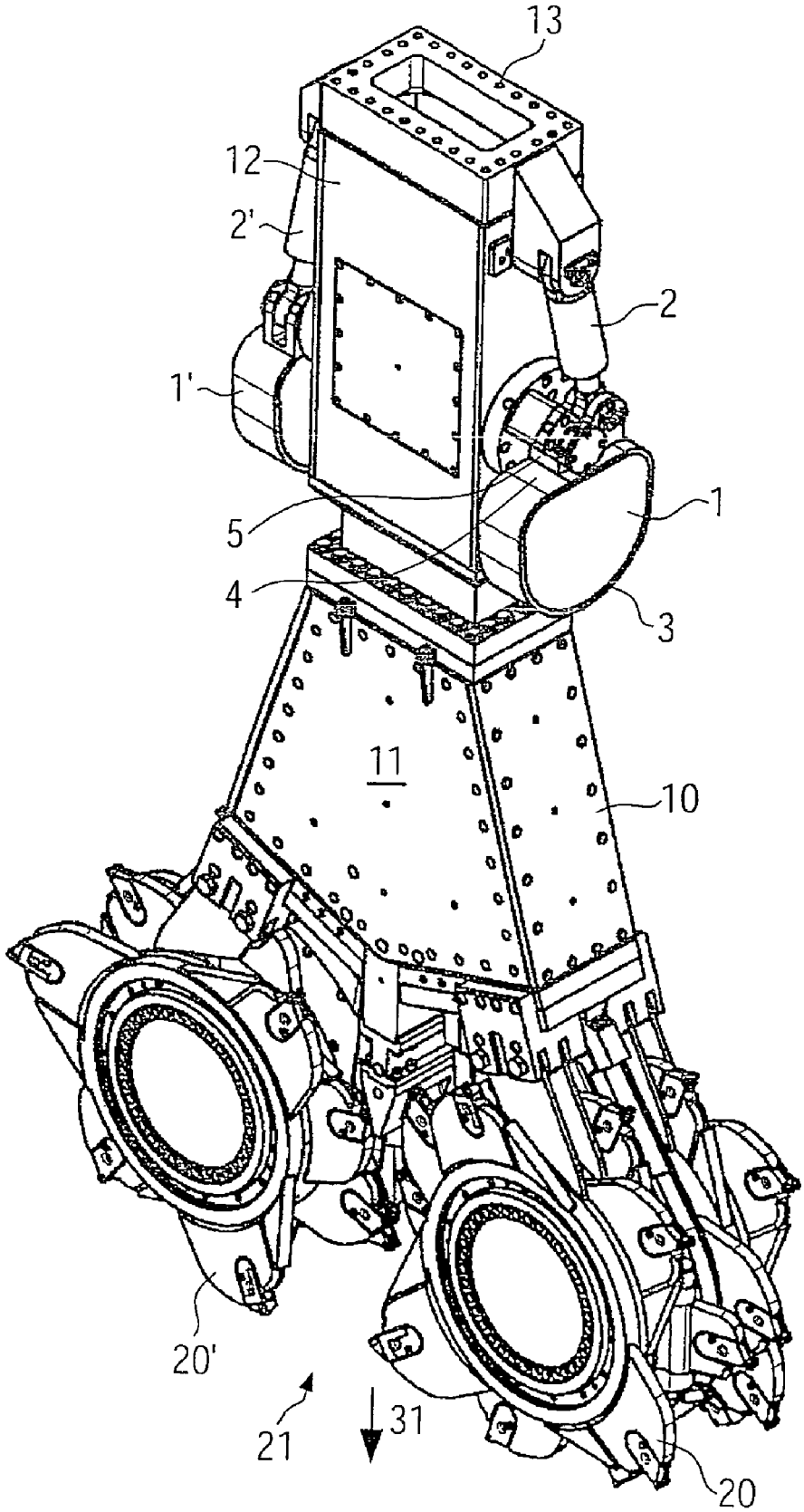
FIG. 1 shows a first embodiment of a foundation construction device according to the invention in perspective view.
Figure 2:
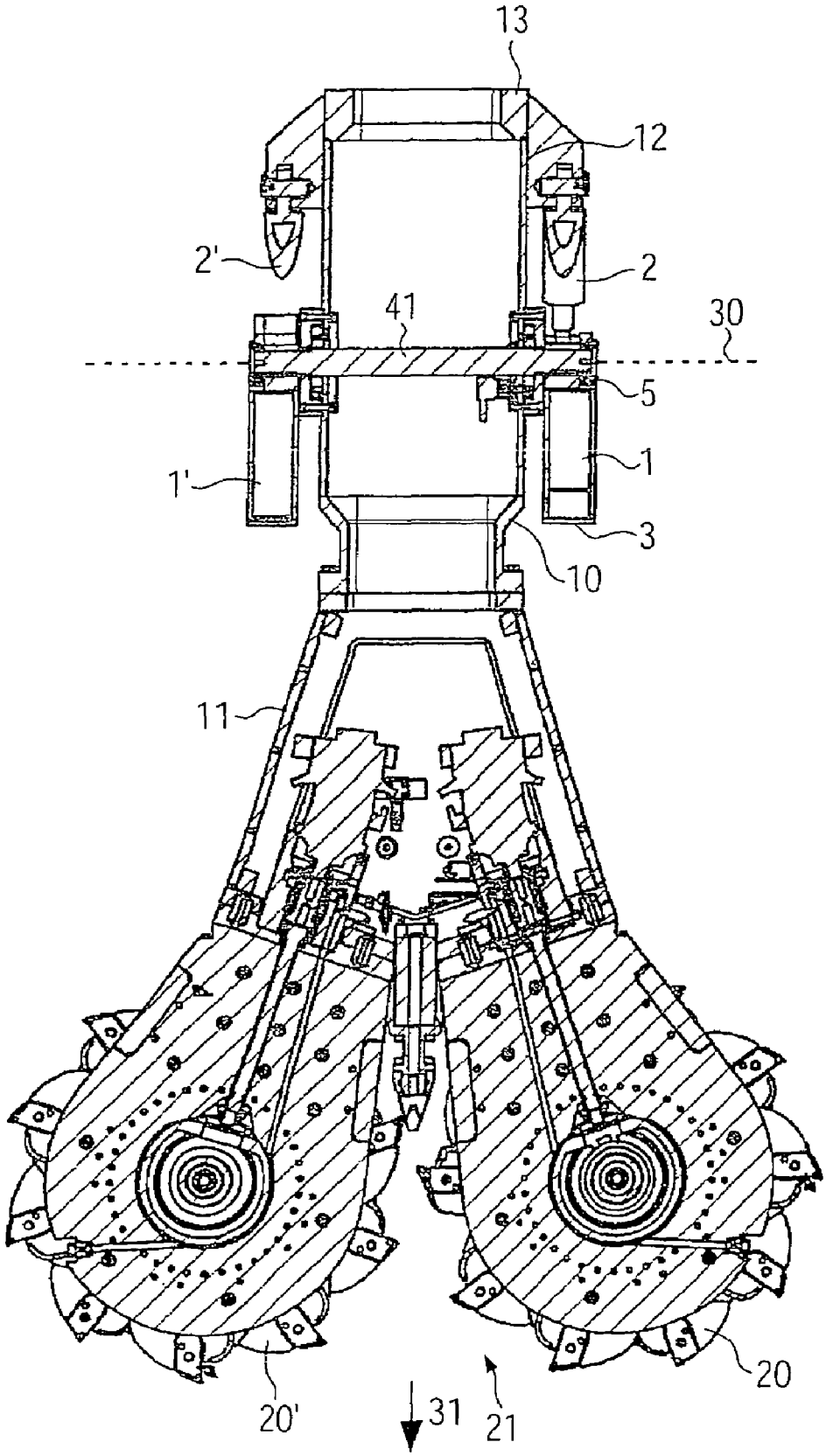
FIG. 2 shows a longitudinal section of the foundation construction device of FIG. 1.

A first embodiment of a foundation construction device according to the invention is illustrated in FIGS. 1 and 2. The foundation construction device is designed as a trench wall cutter and has a soil-removing device 21 with two paraxially arranged cutting wheels 20, 20' that are each designed with two coaxial individual cutting wheels. The two cutting wheels 20, 20' have an approximately rectangular removal cross-section.

The cutting wheels 20, 20' are supported in a rotatably driven manner on the underside of a frame 10. The frame has a first, lower frame part 11, on which the cutting wheels 20, 20' are arranged and the cross-section of which tapers in the upward direction, i.e. in a direction contrary to that of the advance direction 31, with increasing distance to the cutting wheels 20, 20'. The tapering is implemented with respect to the long rectangle side of the rectangular removal cross-section of the soil removing device 21, whereas the dimensions of the frame 10 in the direction of the shorter rectangle side of the rectangular removal cross-section of the soil removing device 21 remain constant.

At the top side of the first frame part 11 of the frame 10, i.e. on the side facing away from the advance direction, a second frame part 12 links up in a detachable manner that has an approximately cuboid design. At the top side of the second frame part 12 a suspension 13 designed as a suspension flange is provided, with which the frame 10 can be connected to a drill rod not depicted in the Figures but also to a rope suspension.

On the second frame part 12 of the frame 10 a control device is provided for controlling the foundation construction device in the trench. This control device has two segmental control bodies 1, 1' that are supported in a pivotable manner on opposite frame sides of the frame 10 about a pivot axis 30 on the second frame part 12 of the frame 10.

As shown on the example of control body 1, each of the segmental control bodies 1, 1' has an arched outer contour 3 arranged on the underside, i.e. positioned in front in the advance direction 31, and a plane bearing surface 4 arranged at the top side. On this bearing surface 4 a bearing eye 5 is provided, by means of which the control body 1 is supported in a rotationally fixed manner on a shaft 41 arranged coaxially to the pivot axis 30. The second control body 1' is designed in analogy and is also supported in a rotationally fixed manner on the shaft 41.

For the active pivoting of the two control bodies 1, 1' a hydraulic cylinder 2 and respectively 2' is provided on each of the said bodies. The hydraulic cylinders 2, 2' are arranged above the control bodies 1, 1' and are hinged on the one hand on the plane bearing surfaces 4 of the control bodies 1 and respectively 1' and on the other hand on the second frame part 12. By means of the segmental control bodies 1 the foundation construction device can be controlled in the case of a variation in the direction of the trench width, i.e. in the direction of the shorter rectangle side of the removal cross-section. For control the control bodies 1, 1' equipped with a bulged outer contour 3 support themselves on the wall of the trench. This kind of control requires very little space and can be carried out in a functionally reliable manner. In particular, a deviation of the foundation construction device in the transverse direction of the trench can be compensated.

The control bodies 1, 1' are dimensioned such that when they are in an inoperative position as illustrated in FIGS. 1 and 2 they lie within the removal cross-section, i.e. the cutting cross-section, of the soil-removing device 21. If the control bodies 1, 1' are pivoted on the common shaft 41 about the pivot axis 30 through an actuation of the hydraulic cylinders 2 and 2', the control bodies 1, 1' project beyond the removal cross-section of the soil-removing device 21 and are able to press the foundation construction device away from the wall of the trench.

Figure 3:
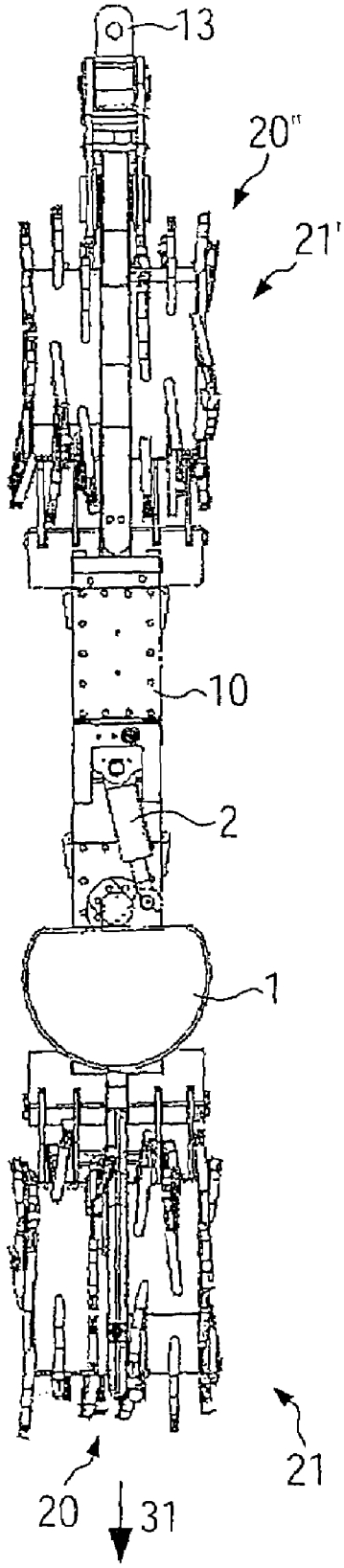
FIG. 3 shows a further embodiment of a foundation construction device according to the invention.

Another embodiment of a foundation construction device according to the invention is shown in FIG. 3. The embodiment of FIG. 3 substantially differs from the embodiment of FIGS. 1 and 2 in that two soil-removing devices 21 and 21' are provided in FIG. 3, wherein the first soil-removing device 21 is arranged on the underside of the frame 10, i.e. positioned in front in the advance direction 31, and the second soil-removing device 21' is arranged at the top side of the frame 10, i.e. positioned at the rear in the advance direction 31. Both soil-removing devices 21 and 21' each have two cutting wheels 20, 20" designed as wheel pairs, with the two second wheel pairs being covered by the first wheel pairs 20, 20" in FIG. 3.

In the embodiment of FIG. 3 the control bodies 1 are arranged between the two soil-removing devices 21 and 21'.

Figure 5:
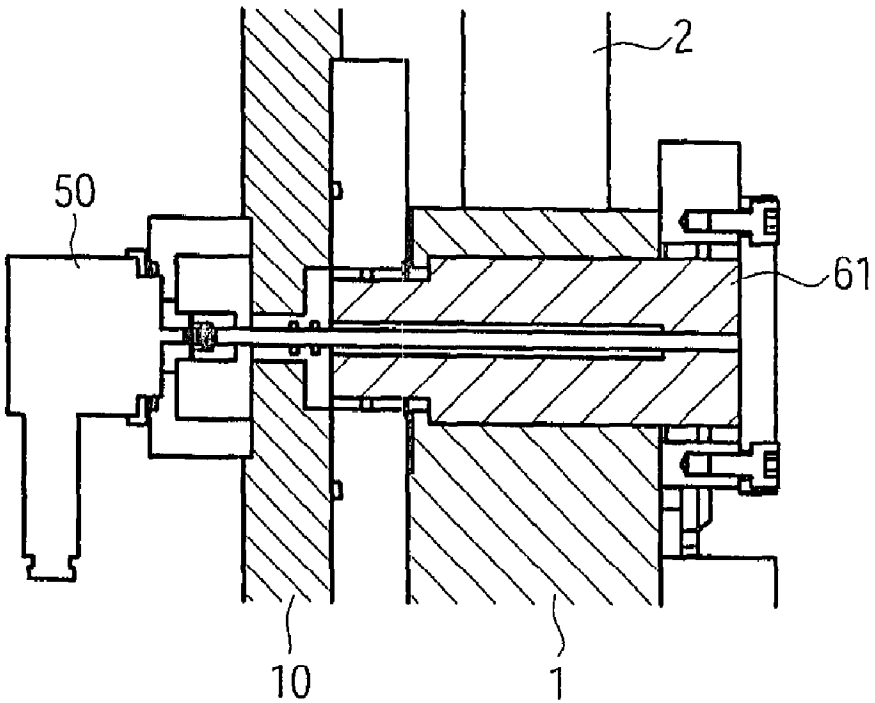
FIGS. 4 and 5 show detailed views in the portion of the support of the control bodies on the frame of two embodiments of foundation construction devices according to the invention.
Figure 4:
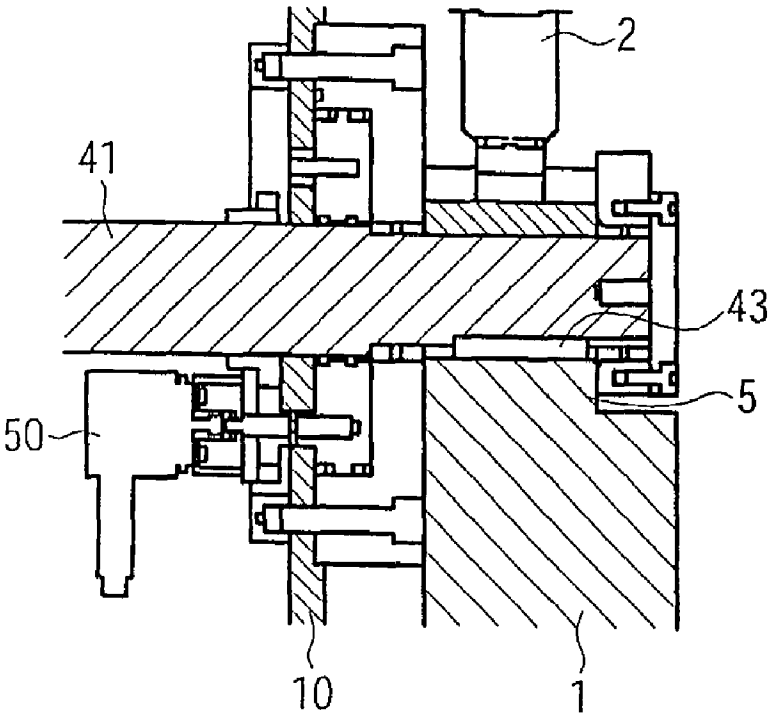

FIGS. 4 and 5 illustrate two different possibilities of supporting the control bodies 1 on the frame 10. Just as in the embodiment of FIG. 2, in the embodiment of FIG. 4 a common shaft 41 is provided, on which both control bodies 1 are supported in a rotationally fixed manner. The common shaft 41 extends through the frame 10. To produce a rotationally fixed connection a slot nut 43 is provided on the bearing eye 5 of the control body 1.

For detection of the angle of rotation of the control body 1 an inductive pick-up 50 is provided on the frame 10 in the part of the common shaft 41.

In the embodiment of FIG. 5 the individual control bodies 1 are supported individually on the housing and can therefore be actuated independently of each other. For the support of the control bodies 1, journals 61 are provided on the frame 10, onto which the control bodies 1 are plugged in a rotatable manner. Likewise, in the case of the embodiment of FIG. 5 a pick-up 50, which extends in this case coaxially to the journal 61, is provided for detecting the angular position of the control bodies 1.

The invention claimed is:

1. Foundation construction device for producing a trench in the soil comprising:

a frame, at least one soil-removing device arranged on the frame and a control device for controlling the foundation construction device in the trench, wherein the control device has at least one control body, wherein the same at least one control body is movable between an inoperative position and a first and second opposite, alternate, projecting control positions in order to rest on a wall of the trench, and wherein the first opposite, alternate projecting control position is on a first side of the frame and the second opposite, alternate projecting control position is on a second side of the frame that lies opposite the first side of the frame.

2. Foundation construction device according to claim 1, wherein the control body is supported on the frame in a pivotable manner about a pivot axis, wherein the pivot axis extends perpendicularly to an advance direction of the foundation construction device.

3. Foundation construction device according to claim 1, wherein the control body has an arched outer contour, in order to rest on the wall of the trench.

4. Foundation construction device according to claim 3, wherein following on from the arched outer contour the control body has a plane bearing surface, on which it is supported on the frame.

5. Foundation construction device according to claim 1, wherein for actuation of the control body at least one hydraulic cylinder is provided, which is supported on the one hand on the frame and on the other hand on the control body.

6. Foundation construction device according to claim 1, wherein two control bodies are provided on opposite sides of the frame and at least one hydraulic cylinder is provided on each of the control bodies.

7. Foundation construction device according to claim 1, wherein the soil-removing device has a rectangular removal cross-section and in that the control body is adjustable in the direction of a shorter rectangle side of the rectangular removal cross-section.

8. Foundation construction device according to claim 1, wherein the soil-removing device has at least one rotatably driven cutting wheel and/or the control body is arranged in a part of the frame, in which the frame is designed in a tapering manner.

9. Method for producing a trench in the soil, comprising the steps of:

introducing a foundation construction device according to claim 1 into the soil and concurrently with the introducing step, actuating the control body in order to control the foundation construction device.

10. Foundation construction device according to claim 3, wherein the control body has an outer contour in the shape of a circular arc.

11. Foundation construction device for producing a trench in the soil comprising:

a frame, at least one soil-removing device arranged on the frame and a control device for controlling the foundation construction device in the trench, wherein the control device has at least one control body, which has an arched outer contour and is movable between an inoperative position and two opposite, alternate, projecting control positions in order to rest on a wall of the trench, wherein the first projecting control position is on a first side of the frame and the second projecting control position is on a second side of the frame that lies opposite the first side of the frame, wherein the control body is supported on the frame in a pivotable manner about a pivot axis, and wherein the pivot axis extends perpendicularly to an advance direction of the foundation construction device, and eccentrically with respect to the arched outer contour of the control body.

12. Foundation construction device for producing a trench in the soil comprising:

a frame, at least one soil-removing device arranged on the frame and a control device for controlling the foundation construction device in the trench, wherein the control device has two control bodies provided on opposite sides of the frame, which are movable between an inoperative position and two opposite, alternate, projecting control positions in order to rest on a wall of the trench, wherein at least one hydraulic cylinder is provided on each of the control bodies, wherein the first projecting control position is on a first side of the frame and the second projecting control position is on a second side of the frame that lies opposite the first side of the frame, and wherein the control bodies are arranged in a rotationally fixed manner on a common shaft.

* * * * *